US008250711B1

(12) United States Patent
Chen et al.

(10) Patent No.: US 8,250,711 B1
(45) Date of Patent: Aug. 28, 2012

(54) SPACE-SAVING SLIDE COVER LIFTING STRUCTURE

(75) Inventors: Chia Hui Chen, Taoyuan (TW); Che-Hsien Lin, Taoyuan (TW)

(73) Assignee: Lianhong Art Co., Ltd., Taoyuan (TW)

( * ) Notice: Subject to any disclaimer, the term of this patent is extended or adjusted under 35 U.S.C. 154(b) by 8 days.

(21) Appl. No.: 13/095,793

(22) Filed: Apr. 27, 2011

(51) Int. Cl.
*E05D 7/00* (2006.01)

(52) U.S. Cl. ..... 16/354; 16/351; 16/239

(58) Field of Classification Search ..... 16/354, 16/366, 365, 368, 369, 370, 352, 239; 361/679.08, 361/679.11, 679.02, 679.15, 679.27; 455/90.3, 455/575.1, 575.3, 575.8; 379/433.12, 433.13; 348/373, 333.01, 333.06, 794
See application file for complete search history.

(56) References Cited

U.S. PATENT DOCUMENTS 4,342,135 A * 8/1982 Matsuo et al. ..... 16/82
4,859,092 A * 8/1989 Makita ..... 400/83
4,960,256 A * 10/1990 Chihara et al. ..... 248/286.1
5,102,084 A * 4/1992 Park ..... 248/286.1
5,103,376 A * 4/1992 Blonder ..... 361/679.09
5,262,762 A * 11/1993 Westover et al. ..... 345/168
5,847,685 A * 12/1998 Otsuki ..... 345/87
5,862,896 A * 1/1999 Villbrandt et al. ..... 188/293
5,987,704 A * 11/1999 Tang ..... 16/354
6,473,936 B2 * 11/2002 Orita ..... 16/82
6,848,759 B2 * 2/2005 Doornbos et al. ..... 312/319.1
7,063,225 B2 * 6/2006 Fukuo ..... 220/264
7,725,988 B2 * 6/2010 Kim et al. ..... 16/361
2007/0084015 A1 * 4/2007 Zuo et al. ..... 16/354
2008/0196201 A1 * 8/2008 Anderson ..... 16/232
2010/0265686 A1 * 10/2010 Kilpinen ..... 361/807

* cited by examiner

*Primary Examiner* — Chuck Y. Mah
(74) *Attorney, Agent, or Firm* — Guice Patents PLLC

(57) ABSTRACT

A space-saving slide cover lifting structure consisting of a pair hinges, a pair of sliding rail holders, a pair of plastic slide guides, a pair of sliding rails, a pair of gears and a pair of gear racks is disclosed. The gear racks are respectively accommodated in the sliding rails to reduce space occupation, minimizing the width of the assembly of the gear rack and the respective sliding rail. The arrangement of the plastic slide guides prohibits direction contact between the metal sliding rails and the sliding rail holders, avoiding friction noise.

8 Claims, 7 Drawing Sheets

SPACE-SAVING SLIDE COVER LIFTING STRUCTURE

BACKGROUND OF THE INVENTION

1. Field of the Invention

The present invention relates to slide cover mounting technology and more particularly, to a space-saving slide cover lifting structure for use in an electronic device, for example, tablet computer, for allowing a top cover to be moved horizontally relative to a base panel and then lifted from a horizontal position to a tilted position.

2. Description of the Related Art

Following development and function improvement of touch control technology, tablet computer has become popular. The LCD screen of a tablet computer is located on the outer surface of the computer for convenient operation.

However, the use of a keyboard is a common practice to most people for, for example, text word input. There are tablet computers that comprise an operating system end arranged at the bottom side of the LCD display panel. Thus, the LCD display panel can be moved horizontally relative to the operating system end and then lifted to a tilted position so that the user can use the keyboard on the operating system end.

To satisfy this operation, a special slide cover mounting arrangement is necessary. The known slide cover mounting arrangement comprises a pair of hinges, a pair of sliding rail holders and sliding rails. However, this design does not allow smooth lifting of the LCD display panel. Gear and gear rack may be added to distribute the applied push force evenly. However, the gear will be disengaged from the gear rack when the user lifts the LCD display panel from the operating system end, and will be pushed back into engagement with the gear rack when the user closes the LCD display panel. Because the gear is not constantly kept in mesh with the gear rack, the LCD display panel may be erroneously biased from position.

U.S. patent application Ser. No. 12/986,353 discloses a slide cover design invented by the present invention and entitled "SLIDE COVERF MOUNTING STRUCTURE", which includes two hinges bilaterally mounted on the top wall of the base member, two sliding rail holders respectively connected to the pivot shafts of the hinges, two sliding rails bilaterally mounted on the bottom surface of the cover panel and respectively slidably coupled to a sliding groove on each of the sliding rail holder, two gears pivotally connected between fixed rails on the sliding rail holders, and two gear racks respectively mounted on the cover panel and meshed with the gears.

Thus, the cover panel is prohibited from biasing during sliding movement, and turnable about the pivot shafts of the hinges from a horizontal position to a tilted position relative to the base member.

U.S. patent application Ser. No. 13/035,121 discloses a slide cover design invented by the present invention and entitled "LIFTABLE SLIDE COVER MOUNTING STRUCTURE USING A SHEET METAL BRACKET MECHANISM", which consists of two hinges, two metal sheet bracket mechanism, two sliding rails, two gears, two gear racks and two supplementary support mechanisms. Subject to the use of the sheet plate bracket mechanisms to hold the sliding rails instead of zinc alloy sliding rail holders, the weight of the liftable slide cover mounting structure is minimized. Further, when the cover panel is opened from the base member, the sheet plate bracket mechanisms are forced into engagement with the supplementary support mechanisms to support the cover panel in position for enabling the user to operate the display screen of the cover panel positively.

In the aforesaid prior art designs, the sliding rails and the gear racks are arranged in a parallel manner, occupying much surface space. In consequence, the size of the tablet PC cannot be minimized.

SUMMARY OF THE INVENTION

The present invention has been accomplished under the circumstances in view. It is main object of the present invention to provide a space-saving slide cover lifting structure for use in an electronic device comprising a cover panel and a base member, which eliminates the drawbacks of the aforesaid prior art design.

To achieve this and other objects of the present invention, a space-saving slide cover lifting structure is used in an electronic device comprising a cover panel and a base member, comprising:

two hinges respectively fixedly mounted in a respective recessed portion on the middle part of the top wall of the base member adjacent to two opposite lateral sides of the base member, each hinge comprising a pivot shaft;

two sliding rail holders respectively connected to the pivot shafts of the two hinges and rotatable relative to the base member, each sliding rail holder comprising a connection block connected to the pivot shaft of the associating hinge;

two plastic slide guides respectively affixed to the sliding rail holders, each plastic slide guide defining a sliding groove;

two sliding rails bilaterally fixedly mounted on the bottom surface of the cover panel in a parallel manner, each sliding rail comprising a flat, elongated base panel affixed to the cover panel, an angled rail extending along one lateral side of the flat, elongated base panel and slidably coupled to the sliding groove of one plastic slide guide;

an axle having two distal ends thereof respectively pivotally coupled to the sliding rail holders;

two gears respectively mounted on the axle near the sliding rail holders; and two gear racks respectively affixed to the flat, elongated base panels of the sliding rails and respectively meshed with the gears.

The two sliding rails are moved with the cover panel in the sliding grooves of the plastic slide guides relative to the base member when the cover panel receives a horizontal push force, and the gear racks are simultaneously moved with the cover panel to rotate the gears, enabling the horizontal push force to be transferred through the gears to two opposite lateral sides of the base member to prohibit the cover panel from biasing during sliding movement. The gears are kept meshed with the gear racks constantly for enabling the cover panel to be turned about the pivot shafts of the hinges from a horizontal position to a tilted position relative to the base member.

When compared to the prior art design, the gear racks of the invention are respectively accommodated in the sliding rails to reduce space occupation, minimizing the width of the assembly of the gear rack and the respective sliding rail. Thus, the width of the two blank side areas at the two opposite lateral sides of the LCD screen of the cover panel can be minimized, shortening the size of the tablet PC.

Further, the width of each said gear rack is approximately equal to the width of the flat, elongated base panel of each sliding rail.

Further, each sliding rail holder comprises a frame plate located on one lateral side thereof and surrounding the sliding groove of the associating plastic slide guide.

Further, the connection block of each sliding rail holder is located on the bottom side of the respective sliding rail holder, defining therein a non-circular hole that is coupled to the pivot shaft of the associating hinge.

Further, each sliding rail holder comprises an axle hole pivotally coupled to one of the two distal ends of the axle.

Further, each sliding rail holder further comprises an arched flange surrounding one end of the axle hole thereof.

Each sliding rail holder further comprises a spring leaf fixedly mounted thereon and pressed on the associating sliding rail. Each sliding rail further comprises a first notch and a second notch for selectively receiving the spring leaf of the associating sliding rail holder when the sliding rails are moved with the cover panel relative to the base member to one of two opposing end limit positions.

DETAILED DESCRIPTION OF THE PREFERRED EMBODIMENT

Figure 1:
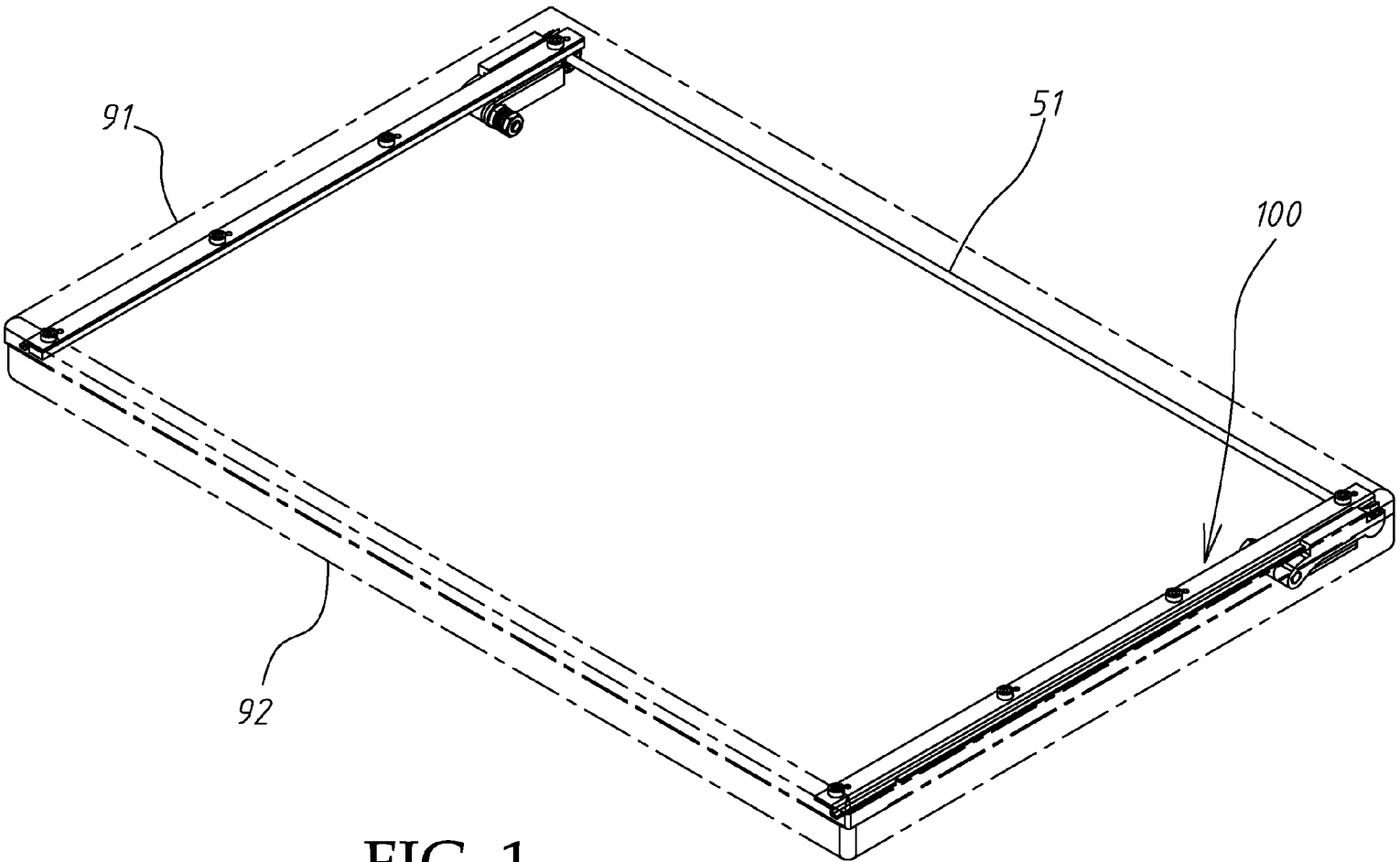
FIGS. 1-3 illustrate the operation of a space-saving slide cover lifting structure used in an electronic device in accordance with the present invention.
Figure 2:
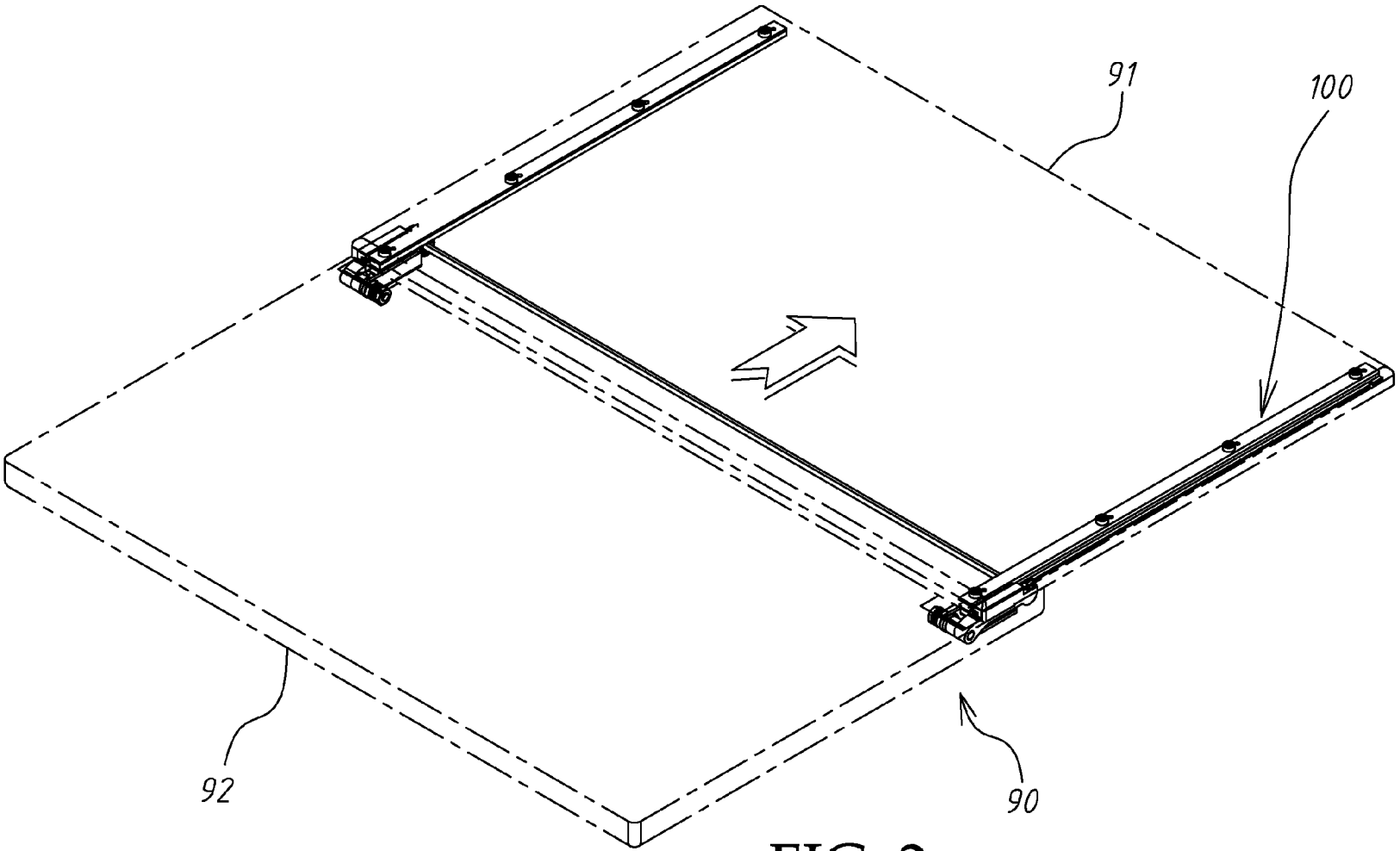
Figure 3:
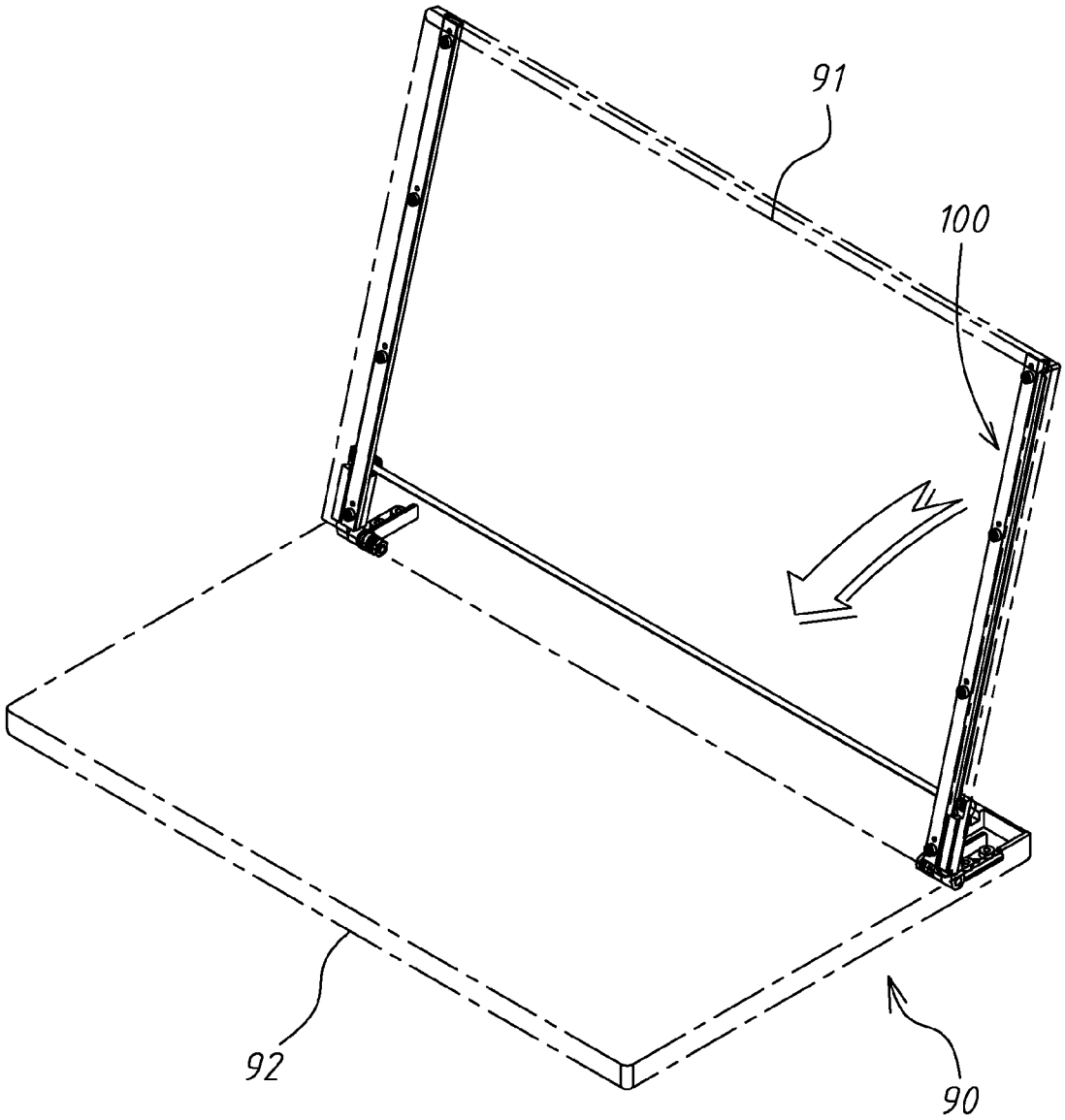

Referring to FIGS. 1-3, a space-saving slide cover lifting structure 100 in accordance with the present invention is shown used in an electronic device 90 comprising a cover panel 91 and a base member 92. The electronic device 90 can be, for example, a tablet computer. The cover panel 91 is a LCD display panel. The base member 92 is the operating system end of the electronic device 90, comprising a keyboard. When opening the cover panel 91, move the cover panel 91 horizontally relative to the base member 92 (see FIG. 2), and then bias the cover panel 91 to a tilted position relative to the base member 92 (see FIG. 3).

Figure 4:
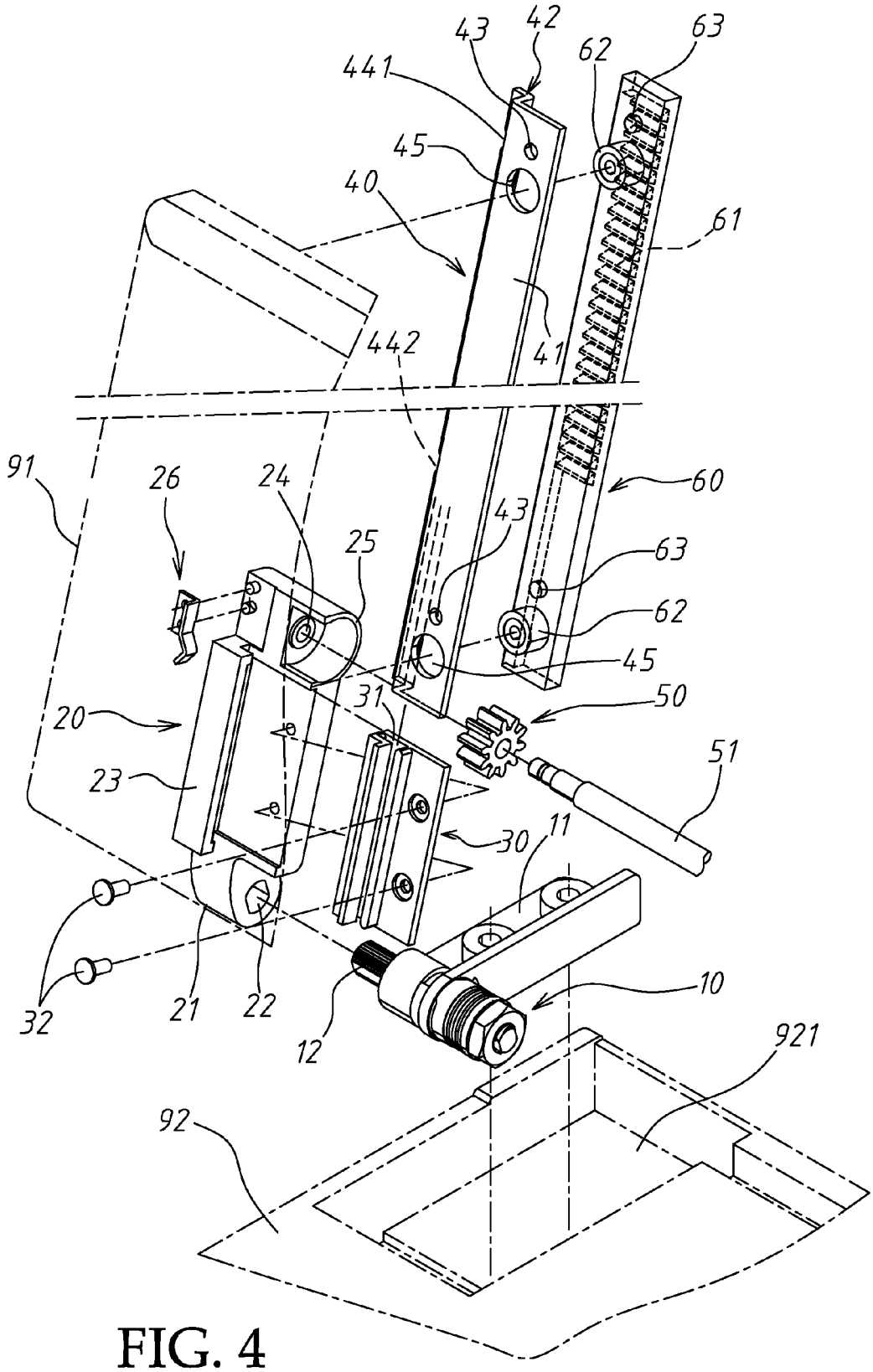
FIG. 4 is an exploded view of a part of the space-saving slide cover lifting structure in accordance with the present invention.
Figure 5:
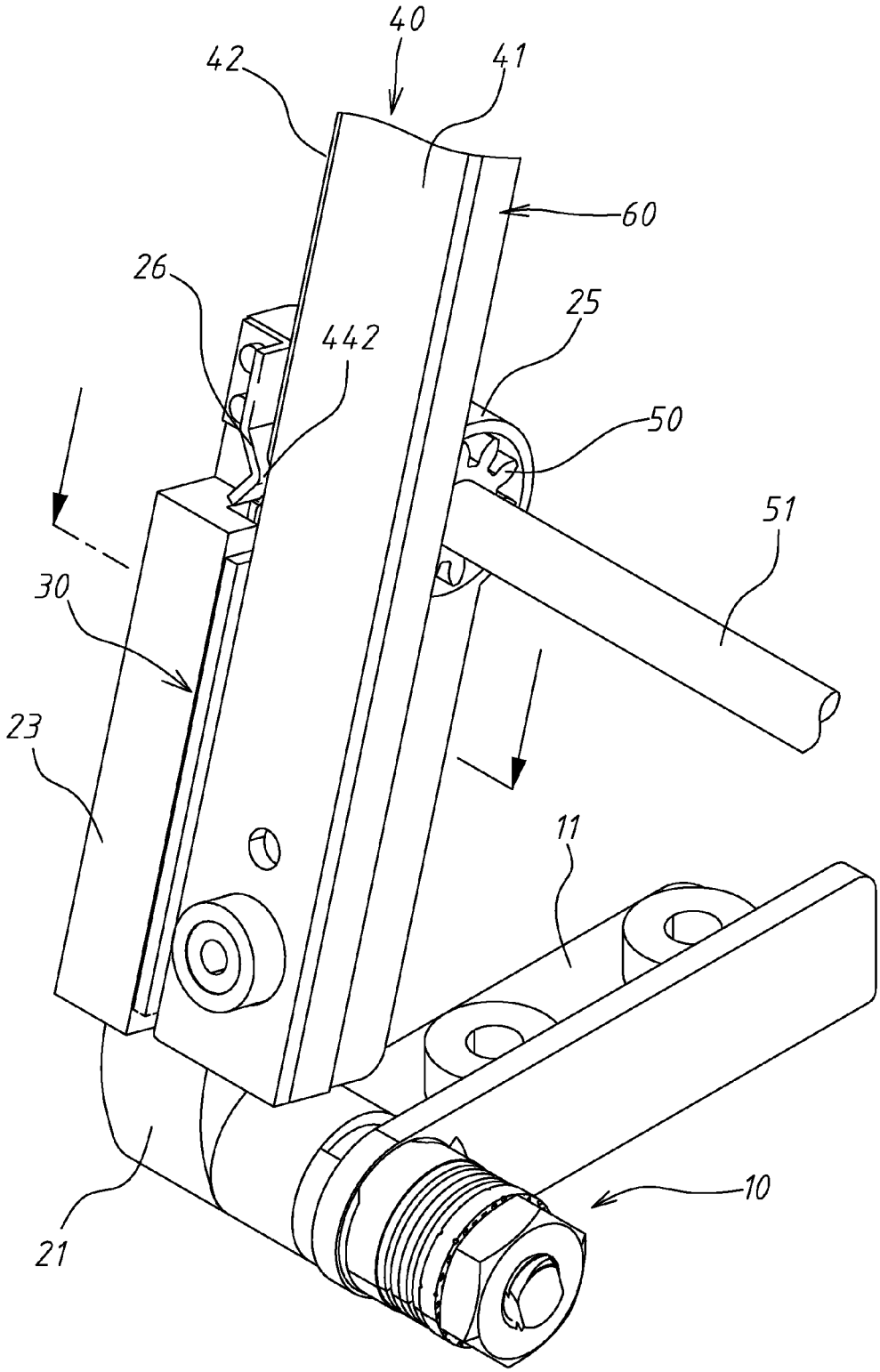
FIG. 5 is an elevational assembly view of a part of the space-saving slide cover lifting structure in accordance with the present invention.

Referring to FIGS. 4 and 5, the space-saving slide cover lifting structure 100 comprises a pair hinges 10, a pair of sliding rail holders 20, a pair of plastic slide guides 30, a pair of sliding rails 40, a pair of gears 50 and a pair of gear racks 60. These component pairs are symmetrically mounted on two distal ends of an axle 51.

The hinges 10 are respectively fixedly mounted in a respective recessed portion 921 on a middle of the top wall of the base member 92 adjacent to the two opposite lateral sides of the base member 92, each comprising a bracket 11, which is affixed one respective portion 921 of the base member 92, and a pivot shaft 12, which is a non-circular shaft. Subject to the torque provided by the hinges 10, the cover panel 91 can be positively positioned in one of a series of tilted positions relative to the base member 92.

Each sliding rail holder 20 comprises a connection block 21 located on the bottom side thereof, a non-circular coupling hole 22 formed in the connection block 21 and coupled to the pivot shaft 12 of one of the hinges 10 for allowing rotation of the respective sliding rail holder 20 with the respective pivot shaft 12 relative to the base member 92, an axle hole 24 located on the top side thereof in a parallel manner relative to the non-circular coupling hole 22, an arched flange 25 surrounding one end of the axle hole 24, a frame plate 23 located on one lateral side thereof and extending in a perpendicular direction relative the extending direction of the non-circular coupling hole 22 and the axle hole 24, and a spring leaf 26 fixedly fastened thereto and disposed adjacent to the top side of the frame plate 23.

The plastic slide guides 30 are respectively affixed to the sliding rail holders 20 with, for example, rivets 32, each defining a sliding groove 31. The sliding grooves 31 of the plastic slide guides 30 are respectively surrounded by the frame plates 23 of the sliding rail holders 20. Subject to the protection of the respective frame plates 23, the sliding grooves 31 of the plastic slide guides 30 are kept in shape for smooth sliding.

Figure 6:
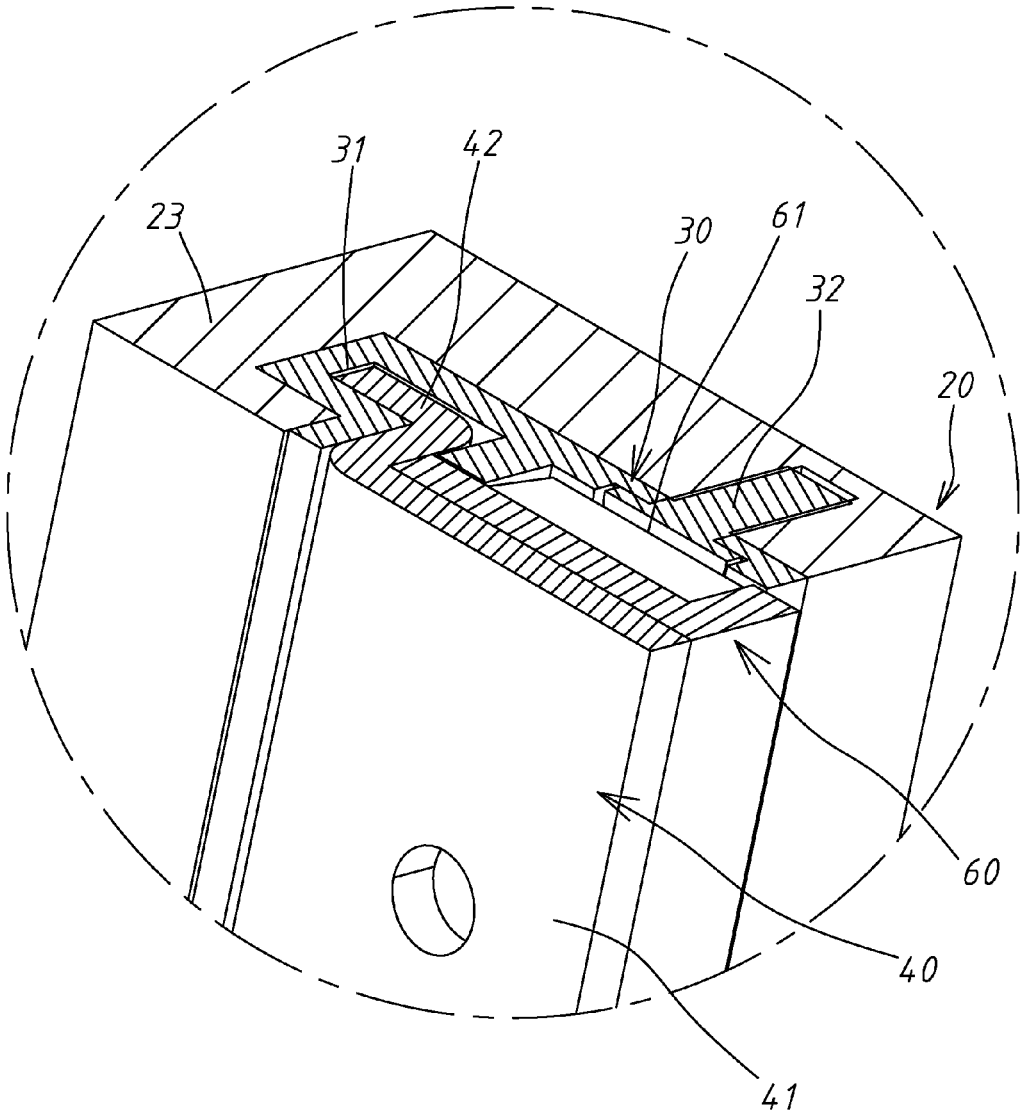
FIG. 6 is a sectional elevation of a part of the space-saving slide cover lifting structure in accordance with the present invention.
Figure 7:
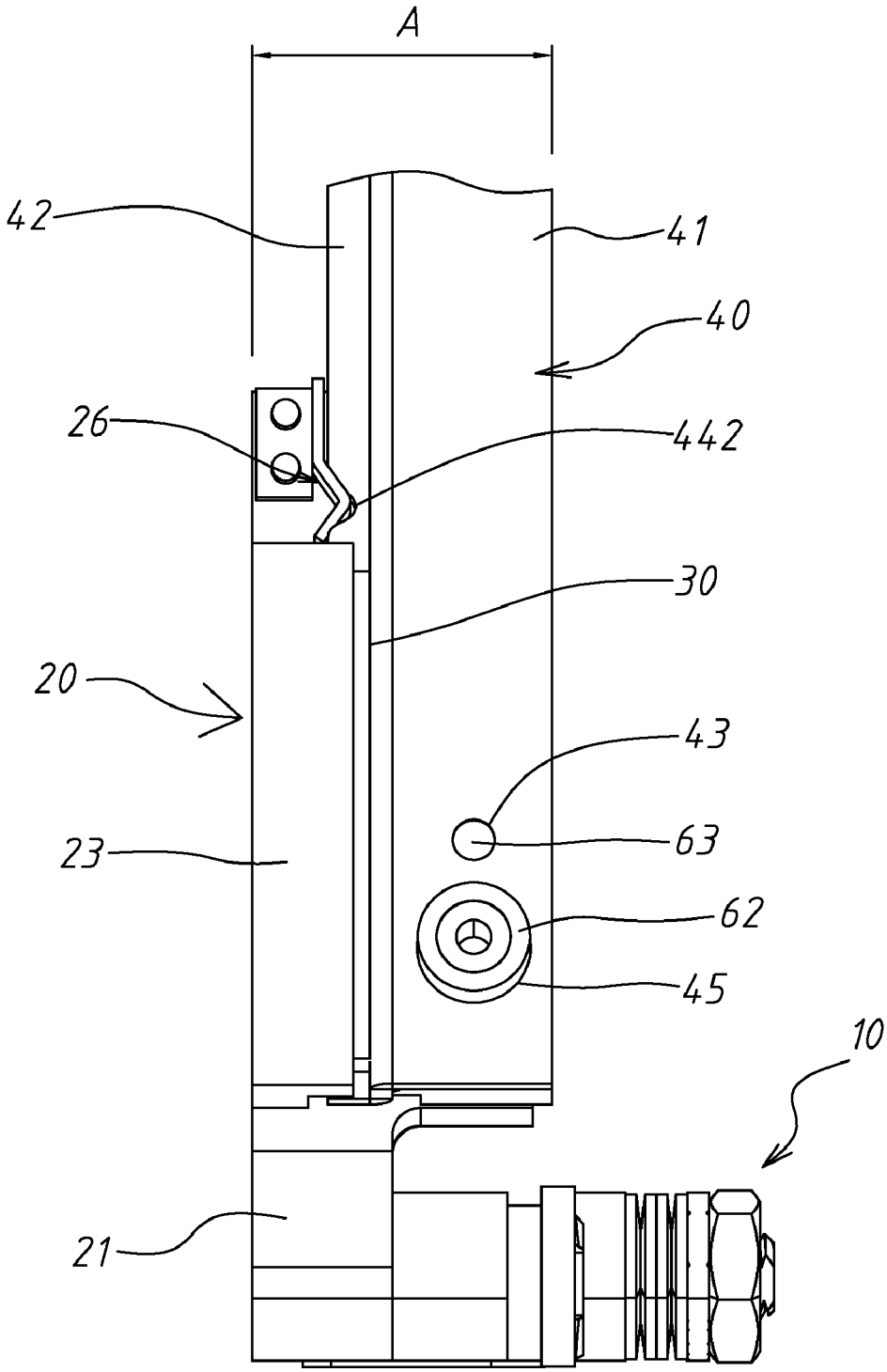
FIG. 7 is a schematic plain view of a part of the space-saving slide cover lifting structure in accordance with the present invention.

The sliding rails 40 are bilaterally fixedly mounted on the bottom surface of the cover panel 91 in a parallel manner, and respectively slidably coupled to the sliding grooves 31 of the plastic slide guides 30. As illustrated in FIG. 6, each sliding rail 40 comprises a flat, elongated base panel 41 affixed to the bottom surface of the cover panel 91, an angled rail 42 extending along one lateral side of the flat, elongated base panel 41 and slidably coupled to the sliding groove 31 of one associating plastic slide guide 30. Further, the sliding rails 40 are respectively pressed on the spring leaves 26 of the sliding rail holders 20. Each sliding rail 40 comprises a first notch 441 and a second notch 442. When sliding rails 40 are moved with the cover panel 91 relative to the base member 92 to one of two opposing end limit positions, the spring leaves 26 are respectively engaged into the first notches 411 or second notches 442 of the sliding rails 40, achieving positioning. FIG. 7 illustrates the spring leaf 26 engaged into the respective second notch 442.

The gears 50 are respectively mounted on the axle 51 near its two distal ends. The two distal ends of the axle 51 are respectively pivotally coupled to the axle holes 24 of the sliding rail holders 20 for allowing free rotation of the gears 50. Further, each gear 50 is surrounded by the arched flange 25 of the respective sliding rail holder 20 for protection.

The gear racks 60 are respectively affixed to the flat, elongated base panels 41 of the sliding rails 40, keeping the respective tooth faces 61 in mesh with the gears 50. Further, the flat, elongated base panel 41 of each sliding rail 40 further comprises a plurality of round holes 43; 45. Further, each gear rack 60 further comprises a plurality of pins 62; 63 respectively inserted into the round holes 43; 45 of the respective sliding rail 40 to secure the respective gear rack 60 to the respective sliding rail 40. The gear racks 60 have a width approximately equal to the width of the flat, elongated base panels 41 of the sliding rails 40 so that the gear racks 60 can be respectively kept in the sliding rails 40 to reduce space occupation. As shown in FIG. 7, when each sliding rail 40 is assembled with the respective gear rack 60, the width A of the assembly is about 10 mm, saving much installation space.

As stated above, the space-saving slide cover lifting structure 100 of the present invention is used in the electronic device 90. When the cover panel 91 receives a horizontal push force, it will slide forwards relative to the base member 92 (see FIG. 2). At this time, the sliding rails 40 are moved in the sliding grooves 31 of the associating slide guides 30, and at the same time, the gear racks 60 are forced to rotate the gears 50, enabling the horizontal push force to be evenly transferred through the axle 51 to the two opposite lateral sides of the base member 92, avoiding biasing of the cover panel 91 during its sliding movement.

Further, the cover panel 91 can be forced by a biasing force to turn about the pivot shafts 12 of the hinges 10 in direction away from the base member 92 to a tilted position (see FIG. 3). During biasing of the cover panel 91, the gears 50 are constantly kept in mesh with the gear racks 60.

When compared to the prior art design, the gear racks 60 are respectively accommodated in the sliding rails 40 to reduce space occupation, minimizing the width of the assembly of the gear rack 60 and the respective sliding rail 40. Thus, the width of the two blank side areas at the two opposite lateral sides of the LCD screen of the cover panel 91 can be minimized, shortening the size of the tablet PC.

Further, subject to the functioning of the plastic slide guides 30 of the space-saving slide cover lifting structure 100, the metal sliding rails 40 are prohibited from direct contact with the sliding rail holders 20, avoiding friction noise.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A space-saving slide cover lifting structure in an electronic device comprising a cover panel and a base member, the pace-saving slide cover lifting structure comprising:

two hinges respectively fixedly mounted in a respective recessed portion on a middle part of a top wall of said base member adjacent to two opposite lateral sides of said base member, each said hinge comprising a pivot shaft;

two sliding rail holders respectively connected to the pivot shafts of said two hinges and rotatable relative to said base member, each said sliding rail holder comprising a connection block connected to the pivot shaft of the associating hinge;

two plastic slide guides respectively affixed to said sliding rail holders, each said plastic slide guide defining a sliding groove;

two sliding rails bilaterally fixedly mounted on a bottom surface of said cover panel in a parallel manner, each said sliding rail comprising a flat, elongated base panel affixed to said cover panel, an angled rail extending along one lateral side of said flat, elongated base panel and slidably coupled to the sliding groove of one said plastic slide guide;

an axle having two distal ends thereof respectively pivotally coupled to said sliding rail holders;

two gears respectively mounted on said axle near said sliding rail holders; and two gear racks respectively affixed to the flat, elongated base panels of said sliding rails and respectively meshed with said gears;

wherein said two sliding rails are moved with said cover panel in the sliding grooves of said plastic slide guides relative to said base member when said cover panel receives a horizontal push force, and said gear racks are simultaneously moved with said cover panel to rotate said gears, enabling the horizontal push force to be transferred through said gears to two opposite lateral sides of said base member to prohibit said cover panel from uneven biasing during sliding movement; said gears are kept meshed with said gear racks constantly for enabling said cover panel to be turned about the pivot shafts of said hinges from a horizontal position to a tilted position relative to said base member.

2. The pace-saving slide cover lifting structure as clamed in claim 1, wherein the width of each said gear rack is approximately equal to the width of the flat, elongated base panel of each said sliding rail.

3. The pace-saving slide cover lifting structure as clamed in claim 1, wherein each said sliding rail holder comprises a frame plate located on one lateral side thereof and surrounding the sliding groove of the associating plastic slide guide.

4. The pace-saving slide cover lifting structure as clamed in claim 1, wherein the connection block of each said sliding rail holder is located on a bottom side of the respective sliding rail holder, defining therein a non-circular hole coupled to the pivot shaft of the associating hinge.

5. The pace-saving slide cover lifting structure as clamed in claim 1, wherein each said sliding rail holder comprises an axle hole pivotally coupled to one of the two distal ends of said axle.

6. The pace-saving slide cover lifting structure as clamed in claim 5, wherein each said sliding rail holder further comprises an arched flange surrounding one end of the axle hole thereof.

7. The pace-saving slide cover lifting structure as clamed in claim 5, wherein each said sliding rail holder further comprises a spring leaf fixedly mounted thereon and pressed on the associating sliding rail; each said sliding rail further comprises a first notch and a second notch for selectively receiving the spring leaf of the associating sliding rail holder when said sliding rails are moved with said cover panel relative to said base member to one of two opposing end limit positions.

8. The pace-saving slide cover lifting structure as clamed in claim 1, wherein the flat, elongated base panel of each said sliding rail further comprises a plurality of round holes; each said gear rack further comprises a plurality of pins respectively inserted into the round holes of the respective sliding rail.

* * * * *